United States Patent [19]

Morris

[11] Patent Number: 4,594,950

[45] Date of Patent: Jun. 17, 1986

[54] TABLE CONSTRUCTION

[76] Inventor: Keith Morris, Rte. 3, Grand Marais, Minn. 55604

[21] Appl. No.: 626,409

[22] Filed: Jun. 29, 1984

[51] Int. Cl.[4] ..... A47B 35/00

[52] U.S. Cl. ..... 108/50; D6/450; D6/451; 108/150; 272/8 N

[58] Field of Search ..... 108/50, 149, 151, 101, 108/161, 150; D6/450, 451; 272/8 N; 273/239; 446/135, 27; 426/13, 15; 40/615

[56] References Cited

U.S. PATENT DOCUMENTS

| | | | |
|---|---|---|---|
| D. 22,518 | 6/1893 | Boller | D6/451 X |
| D. 162,247 | 2/1951 | Smith . | |
| D. 268,555 | 4/1983 | Rosen . | |
| D. 271,166 | 11/1983 | Morabito . | |
| 2,976,039 | 3/1961 | Chouinard | 272/8 N |
| 3,034,320 | 5/1962 | Feibelman | 63/14 R |
| 3,103,899 | 9/1963 | Macken | 108/150 X |
| 3,132,859 | 5/1964 | Braunhut | 272/8 N |
| 3,212,952 | 10/1965 | Turner . | |
| 3,600,737 | 1/1970 | Shore | 446/135 X |
| 3,610,175 | 10/1971 | Wilton et al. . | |
| 3,613,133 | 10/1971 | Isola et al. . | |
| 3,742,871 | 7/1973 | Kienel . | |
| 3,785,648 | 1/1974 | Kobayashi | 446/135 X |
| 4,001,959 | 1/1977 | Grendahl . | |
| 4,148,199 | 4/1979 | Boykin | 272/8 N X |
| 4,289,724 | 9/1981 | Baynard . | |

FOREIGN PATENT DOCUMENTS

| | | | |
|---|---|---|---|
| 1575298 | 9/1980 | United Kingdom | 108/161 |

*Primary Examiner*—William E. Lyddane
*Assistant Examiner*—Peter A. Aschenbrenner
*Attorney, Agent, or Firm*—Bruns and Wall

[57] ABSTRACT

A decorative table combination includes a transparent top supported above a base, and a marine or aquatic creature figure representing a duck, beaver, whale, etc. To create the illusion that the creature is swimming or floating, with the transparent top representing the surface of the creature's habitat, the figure is cut at its natural water line. An upper portion of the figure is supported on the table top, and a lower portion, representing the submerged legs and feet, e.g., of the swimming or floating creature, is supported on the under surface of the table top, directly beneath the upper portion. The two portions can be joined magnetically across the table top. Supports for the table can be fashioned to resemble submerged driftwood, tree branches, or lily pad stems, with suitable continuation members on the table top to give the illusion that the support members break the water's surface.

17 Claims, 19 Drawing Figures

TABLE CONSTRUCTION

This invention relates to the construction of furniture, especially tables. The invention is more particularly directed to a decorative table or the like in which objects disposed on the surface of the table appear to be supported in a body of water, and in which supports for the table can appear to be driftwood, submerged tree branches, pond lilies, or other natural submerged objects which pierce the surface of the body of water. The invention is further directed to the combination of such a table with an aquatic or marine animal figure whose natural habitat is a body of water, arranged to give the appearance that the animal is swimming or floating in the body of water.

Previous attempts to use glass-top furniture to bring out a wildlife theme or wilderness motif have failed to carry out the illusion that the glass table top could be the surface of a pond, lake, or other body of water. Such furniture might comprise, for example, a plate glass member supported atop a carved structure, or else a glass top supported by a cypress knee or root, or driftwood support member. In addition, there have been no suitable means providing any degree of realism to marine or aquatic animal figure so that it appears to be floating or swimming on the surface of the body of water (i.e., on the glass table top). As often as not, any marine or aquatic animal would be represented merely by a "decoy", that is, by a figure representing only the part of the creature that is above the water line.

Accordingly, it is an object of this invention to provide a table or other like item in which the table surface appears to be the surface of a body of water, the supports for the surface appear to be submerged structures, such as aquatic plants, driftwood, or submerged tree branches, which would rise from the bottom of the body of water to pierce the surface thereof.

It is another object of this invention to provide a table or like structure in which a figure representing a marine or aquatic creature, such as a duck, loon, or other water fowl, or a beaver, muskrat, otter, whale, or other marine mammal, appears to be swimming or floating in the body of water, with an upper part of the figure being supported on top of the table top, and a lower part, representing the submerged part of the swimming or floating creature, being supported on the lower surface of the table top and aligned with the upper part of the figure.

In accordance with one aspect of this invention, there is provided a decorative table, or the like, in which objects on the table appear to emerge from the surface of a natural body of water. Support members rise from a base member to a predetermined height, and resemble the submerged portions of natural items which might normally be found in a pond, lake, marsh, etc., protruding from the water. These can be, e.g., partly submerged logs or tree branches, lily pad stems or other marine or aquatic plants, driftwood, etc. A flat transparent table top member (plate glass, acrylic sheet, etc.) is supported on these support members, and gives the illusion of being the surface of the body of water. In a preferred embodiment, the table top is clear plate glass; however, a glass or plastic top having a greenish or brownish tinge or having a slightly clouded appearance may be suitable to represent the natural habitats of certain aquatic creatures.

Continuation members for these support members are attached to an upper surface of the table top and are aligned with their respective support members. These continuation members provide the appearance that the support members pierce the surface of the body of water. For example, if the support member is a natural, carved, or moulded member resembling the submerged portion of a tree branch, the corresponding continuation member would represent the above-water portion of the tree branch. Both portions are cut horizontally, with the table top being supported on the support member, and the continuation member being mounted on the table top (e.g., by use of pins cemented to the table top or by magnets) and in alignment with the support member. For example, if the support member is an iron or steel rod representing the stem of a pon lily, then the continuation member would be a lily pad or a water lily blossom.

In many preferred embodiments of this invention, an aquatic or marine animal figure is disposed on the table top rendering the appearance of an aquatic or marine creature swimming or floating on the water's surface, the latter being represented by the table top. This animal figure includes an upper figure member fashioned to resemble an above-water portion of the aquatic or marine creature, and this member is supported on the upper surface of the table top. The figure also includes a lower figure member fashioned to resemble an underwater portion of the aquatic or marine creature. The lower figure member is supported on an under surface of the table top and is aligned with the upper figure member such that the upper and lower members together form the aquatic animal figure. Favorably, the upper figure portion and lower figure portion are held together magnetically, so that the marine or aquatic animal figure can be moved about on the table top, or can be removed and replaced with a figure representing a different marine or aquatic creature.

The above and many other objects, features, and advantages of this invention will become more apparent from the ensuing detailed description of several preferred embodiments, which description is to be considered in connection with the accompanying drawings, in which FIG. 1 is a perspective view of a table according to a first embodiment of this invention;

With reference to the drawings, and initially to FIGS. 1–4 thereof, a decorative table 10 is formed of a base 12 and a flat plate-glass oval 14 forming the table top. In. other embodiments, the top 14 can be of any arbitrary shape, and could be formed of any other suitable material.

Figure 1:
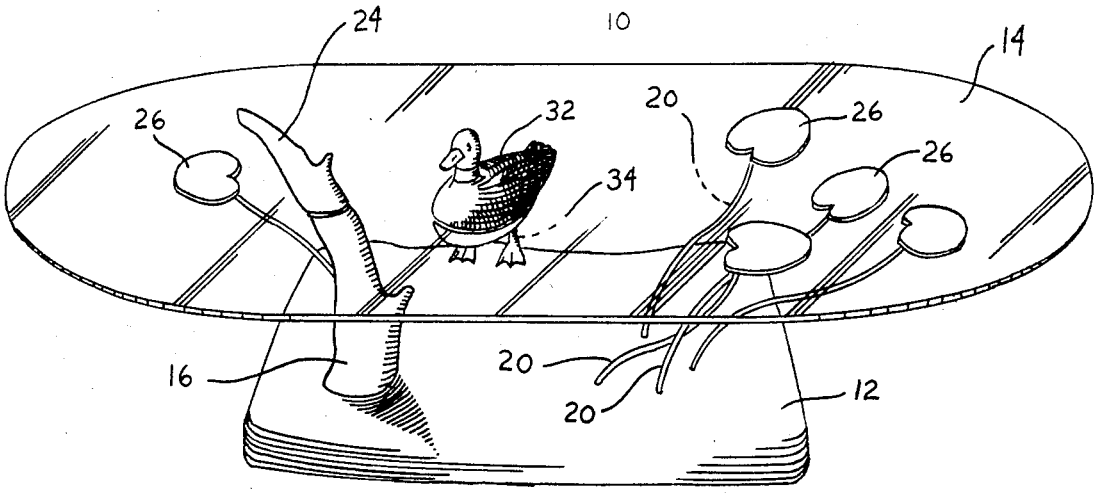
Figure 2:
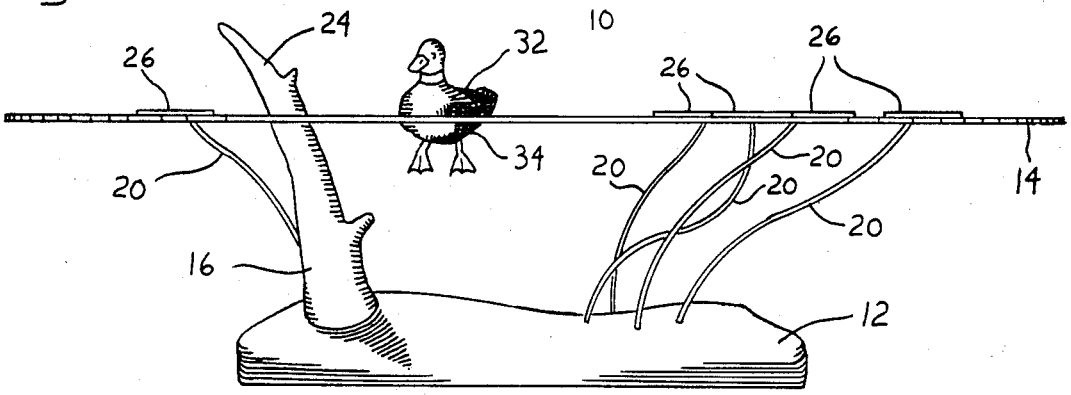
FIGS. 2 and 3 are side elevation and plan views, respectively, of the table of FIG. 1.
Figure 3:
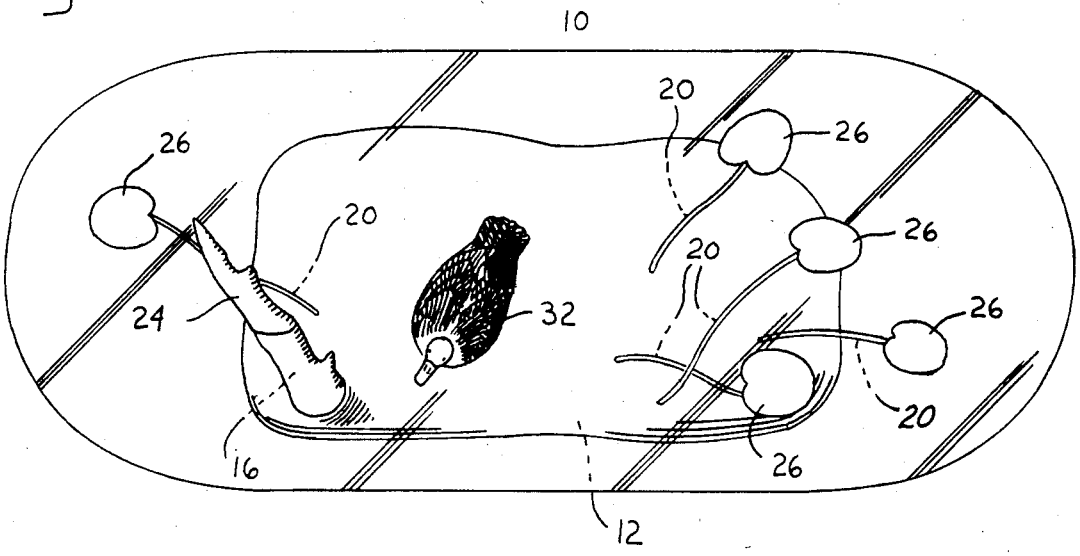
Figure 4:
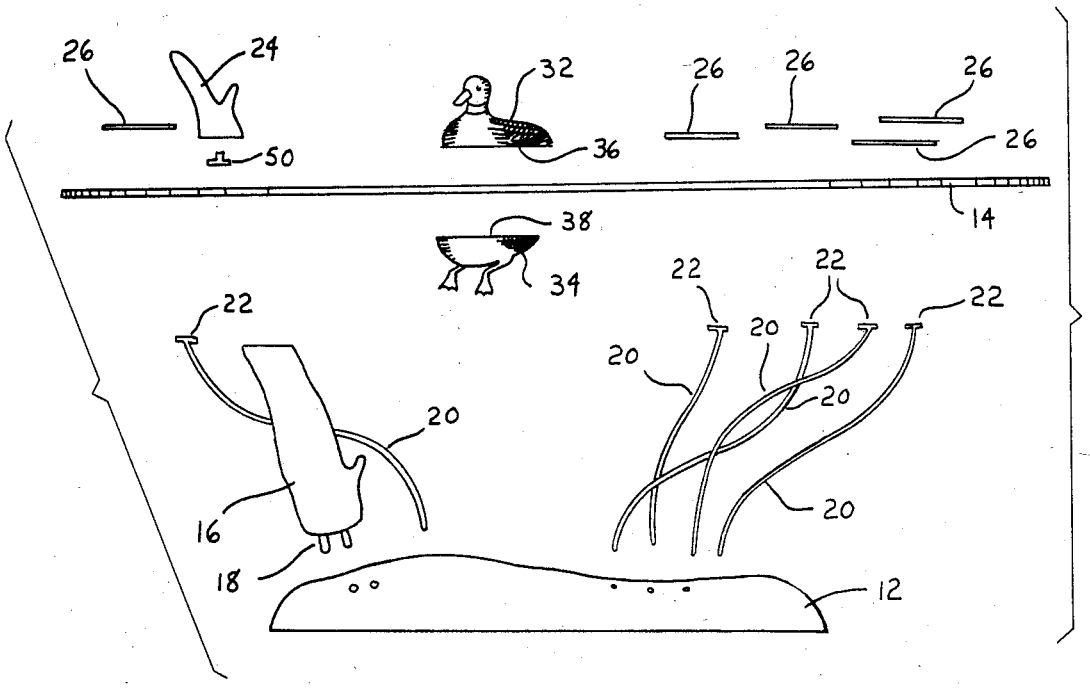
FIG. 4 is an exploded elevational view of the table of FIG. 1.

A typical table support member 16 is shown emerging slopingly upward from the base 12 a predetermined distance, and the table top 14 rests on an upper horizontal surface of the support member 16. In these drawings, the support member 16 is shaped to resemble a tree branch, piece of driftwood, or the like which might be resting on the bottom of a pond or other body of water (the bottom being represented by the base 12), and which would rise through the surface of the pond or body of water. This support member 16 is favorably joined to the base 12 by gluing it with the use of dowels 18 (FIG. 4). Other support members include steel rods 20 which rise from the base 12, and which are at least slightly swept from the vertical to resemble the stems of pond lily plants or other aquatic plants. These rods 20 rise the same vertical distance as the support member 16 and have blocks or discs 22 at their upper ends, on which rests the table top 14.

A tree branch extension 24 is cut horizontally at its base and is held in place atop the glass table top 14 with a pin, magnets, or glue, and is aligned with the support member 16. Similarly, carved or moulded members 26, intended to resemble pond lily pads, rest atop the table top 14 and are aligned with the respective ones of the discs 22 atop associated ones of the rods 20. These members 26 are green in color, and favorably contain magnets in their lower surface to locate the respective members 26 with their associated blocks or discs 22.

An aquatic animal FIG. 30 comprising an upper half 32 and a lower half 34 sandwiching the table top 14 resembles an aquatic or marine creature (here, a duck) floating or swimming on the pond surface represented by the table top 14. This FIG. 30 can be from about half-scale to about full size, relative to the duck it resembles.

Figure 5:
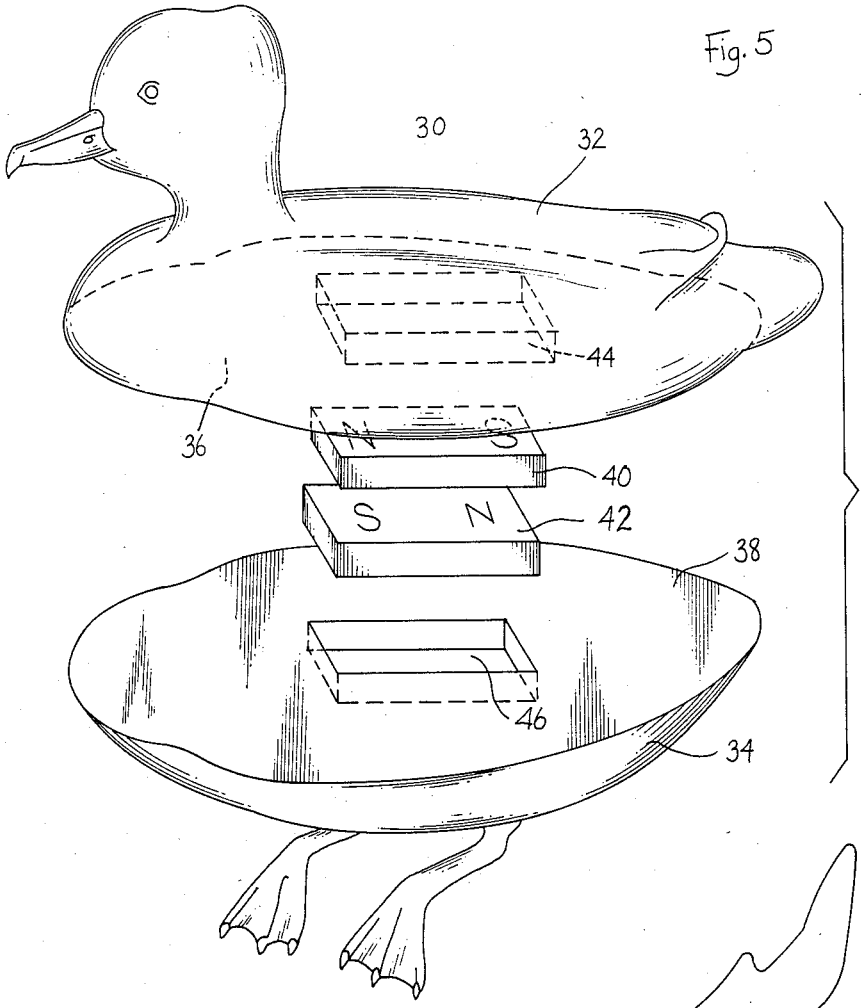
FIG. 5 is a view showing magnetic support means within the aquatic creature of the embodiment of FIG. 1.

As shown in FIG. 5, the upper half 32 of the animal FIG. 30 has a lower surface 36, which is normally flush with the upper surface of the table top 14, and the lower half 34, 30 has an upper horizontal surface 38 which is to be disposed flush with the lower surface of the table top 14. One or more magnets 40 are embedded in the lower surface 36 of the upper half 32, while one or more corresponding magnets 42 are embedded in the upper surface 38 of the lower figure half 34. Respective recesses 44, 46 are provided for the magnets 40, 42. The magnets 40 and 42 are arranged to align and hold the lower half 34 of the FIG. 30 with the upper half 32 when the latter is resting on the table top 14.

The surfaces 36 and 38 can favorably have a coating of Teflon or other suitable low-friction polymer so that the FIG. 30 can be moved about on the table top 14.

By including the lower half 34 of the aquatic animal FIG. 30, the aquatic creature is rendered much more life-like. That is, the creature 30 is not a decoy, but is a complete creature figure, disposed both above and below the surface of the water of its natural habitat. The rendering of tree branches, driftwood, lily pads, etc. also contribute to a more life-like and realistic effect by placing the creature FIG. 30 in its natural habitat.

By having the animal FIG. 30 attached with the magnets 40 and 42, its position on the table can be changed at any time to create a new table arrangement. Other animal figures can be added to or removed from the table top 14 to form new arrangements. In this way, a virtually unlimited variety of table top displays or arrangements can be created, and the animal figures can be changed within a few seconds.

Also, if all of the upper parts 24, 26, 32 are attached by magnets to their lower counterparts 16, 20, 34, the glass table top can be removed easily for cleaning, or to replace it.

Figure 6:
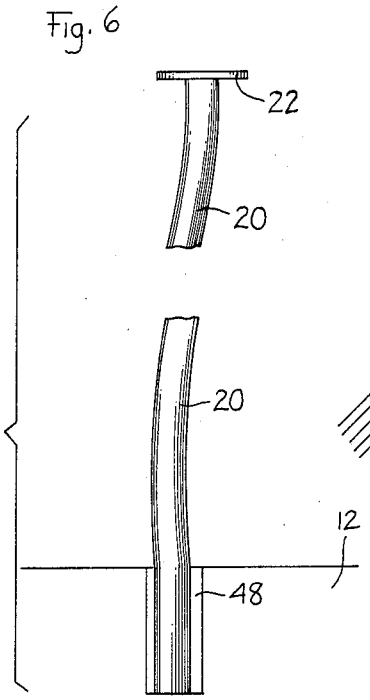
FIGS. 6, 6A, 6B and 7, 7A are views depicting second and third embodiments of the table of this invention.
Figure 6A:
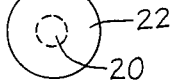
Figure 6B:
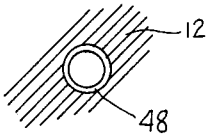

FIGS. 6, 6A, and 6B show details of construction of the stems associated with the lily pads and water lily blossoms. The stem 20 is formed of a steel rod, approximately one-quarter-inch diameter. A disk 22 (FIG. 6A) is welded, soldered, or glued to the top of the steel rod 20 to provide support for the lower surface of the glass table top 14. The lower end of the steel-rod stem 20 is supported in a metal ferrule 48 embedded in the material of the base 12, as shown in FIG. 6B.

Figure 7:
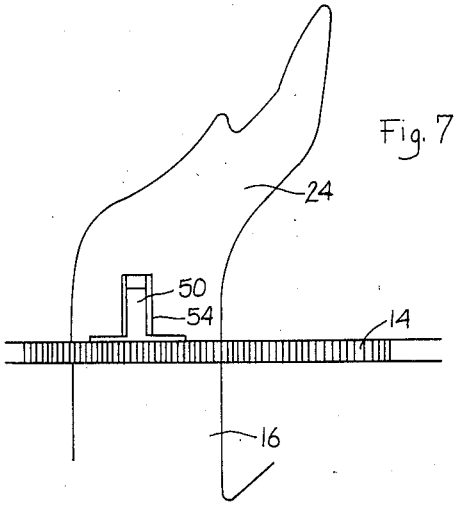
Figure 7A:
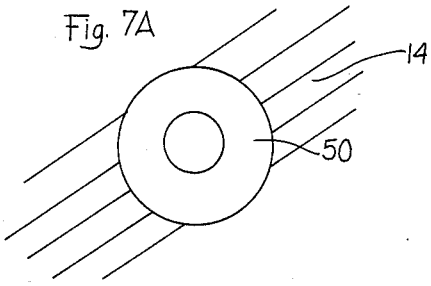

As shown in FIGS. 7 and 7A, the driftwood or tree branch formed of the support member 16 and the continuation member 24 together appear to project through the glass table top 14. In this embodiment, a metal or plastic pin 50, of generally top-hat shape, attaches the continuation member 24 to the upper surface of the table top 14. This pin 50 is secured, for example by glue, to the glass table top 14. Care is taken in its initial placement so that the table support member 16 and the continuation member 24 appear as a continuous tree branch or continuous piece of driftwood. In this embodiment, the pin 50 projects into a vertical bore 52 in the continuation member 24, where it friction-fits into a metal or plastic ferrule 54. The pin 50 and ferrule 54 can either be secured with glue or left as a friction fit.

In this embodiment, and preferably for tables of this invention, the support members 16 and 20 are disposed substantially inwards from the edges of the table top 14. This lends to the illusion that the table is but a portion of the habitat of the duck or other creature represented by the figure 30.

Figure 8:
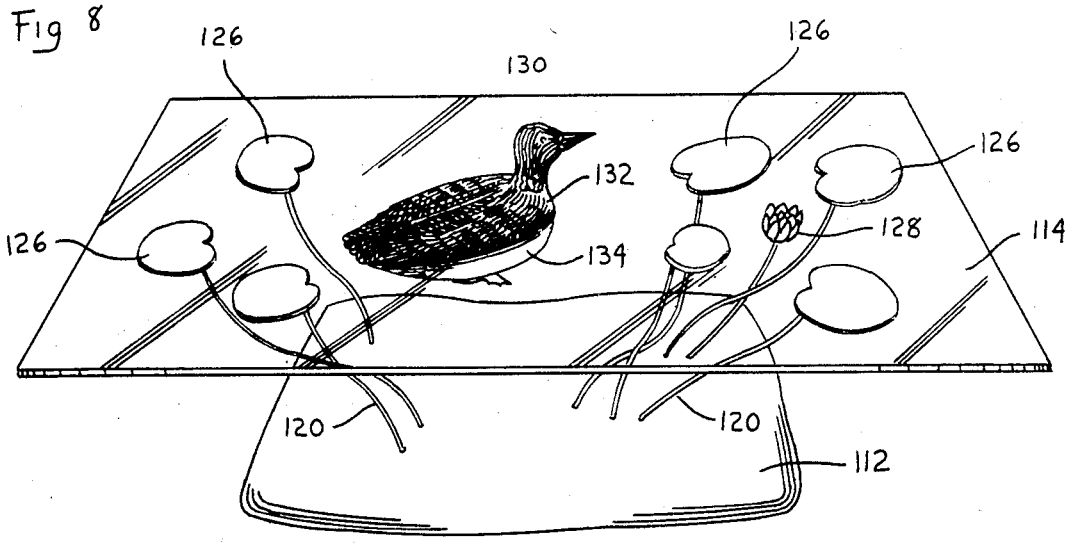
FIGS. 8 and 9 are perspective and elevational views of a fourth embodiment of this invention.
Figure 9:
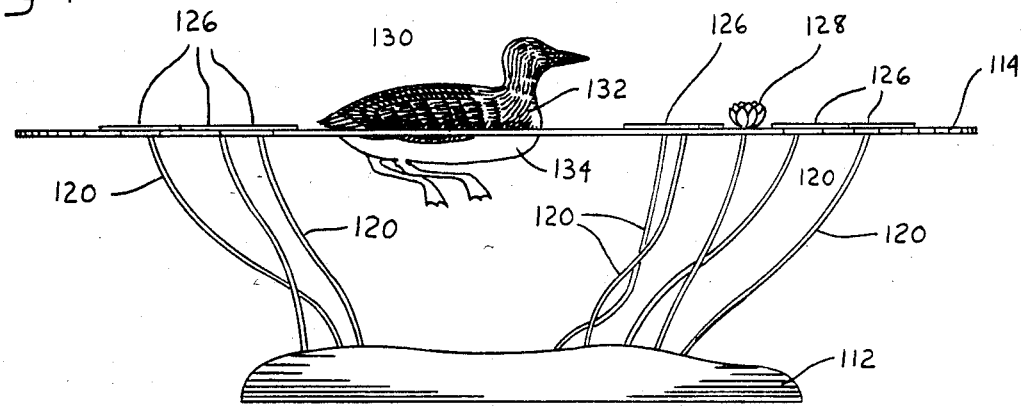

A table 110 according to a second embodiment of this invention is shown in FIGS. 8 and 9. In this embodiment, a loon FIG. 130 appears to be swimming among lily pads 126. Lily pad stems 120, formed as previously of quarter-inch steel rods, provide the entire support for the glass table top 114, and there are no driftwood or tree limb supports. The loon FIG. 130 is formed of an upper half 132 and lower half 134 separated at a plane corresponding to the water line of the swimming loon. Here, in addition to lily pads 126 there is also a water lily blossom 128, which can be formed of wood, ceramic, plastic, metal, or other suitable material. The water lily blossom 128 can be attached to the glass surface by means of glue, double-stick tape, or may be connected magnetically to the associated stem 120. The upper and lower halves 132 and 134 of the bird FIG. 130 are preferably coupled magnetically with structures similar to that shown in FIG. 5.

The base 112 can be made of wood, metal, plastic, or ceramic material, and, as with the first embodiment, the glass table 114 can be of any arbitrary shape, or, can be made of acrylic or other plastic material, rather than glass.

Figure 10:
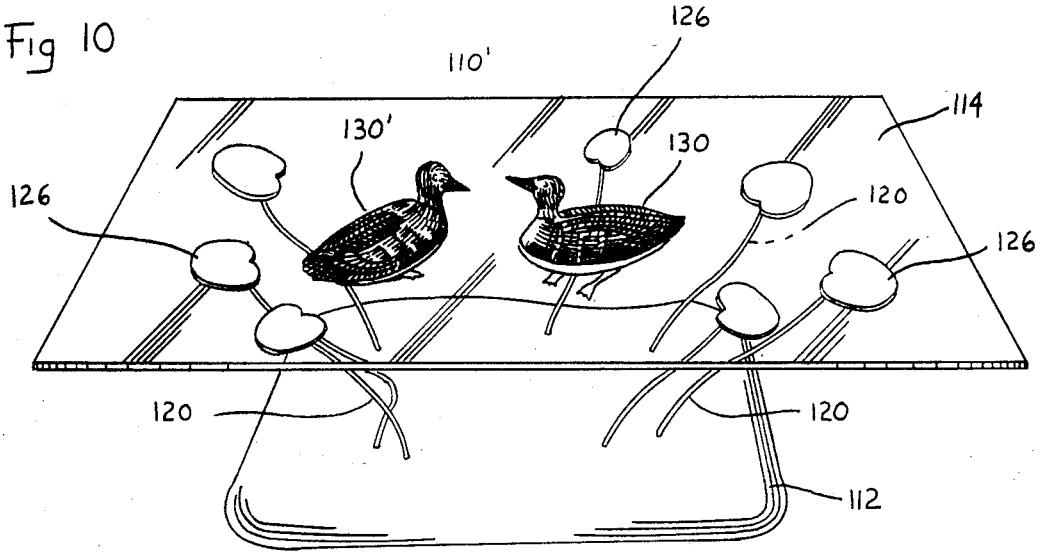
FIG. 10 is a perspective view of a fifth embodiment of this invention.

In FIG. 10 there is shown a variation wherein a pair of aquatic bird FIGS. 130 and 130', here depicted as loons, are disposed on the table top 114. Each FIG. 130 and 130' has a top portion and a respective bottom portion (obscured in the drawing) connected magnetically thereto.

Figure 11:
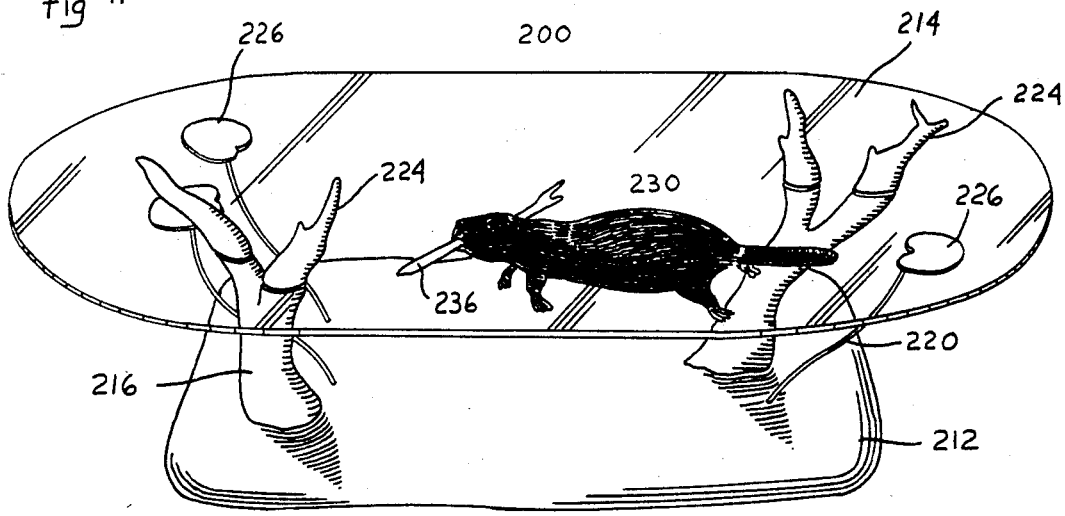
FIGS. 11 and 12 are perspective and side elevation views of a sixth embodiment of this invention.
Figure 12:
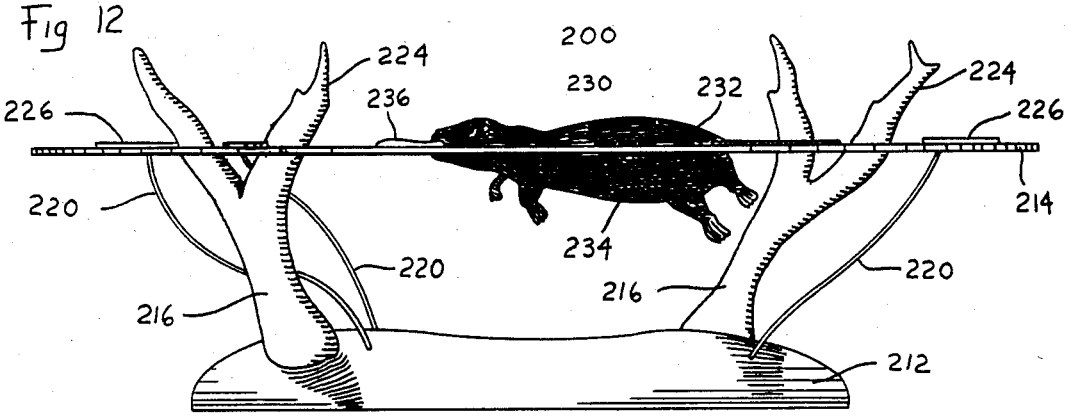

FIGS. 11 and 12 illustrate a table 200 constructed according to yet another embodiment of this invention. Here, tree-branch or driftwood supports 216 rise from either end of the base 212 and provide the principal support means for the table top 214. Extension portions 224 of the support 216 extend upwardly above the table top 214, and can be constructed generally as shown in FIG. 7 and as described hereinabove. In this embodiment, a beaver FIG. 230 represents an adult beaver swimming with a stick 236 in its mouth. Here the beaver FIG. 230 has an upper portion 232 corresponding to the portion of the swimming beaver above the water line, and lower portion 234 corresponding to that part of the beaver which is submerged while swimming. Also, as with the previous embodiments, there are lily stems 220 and lily pads 226.

Figure 13:
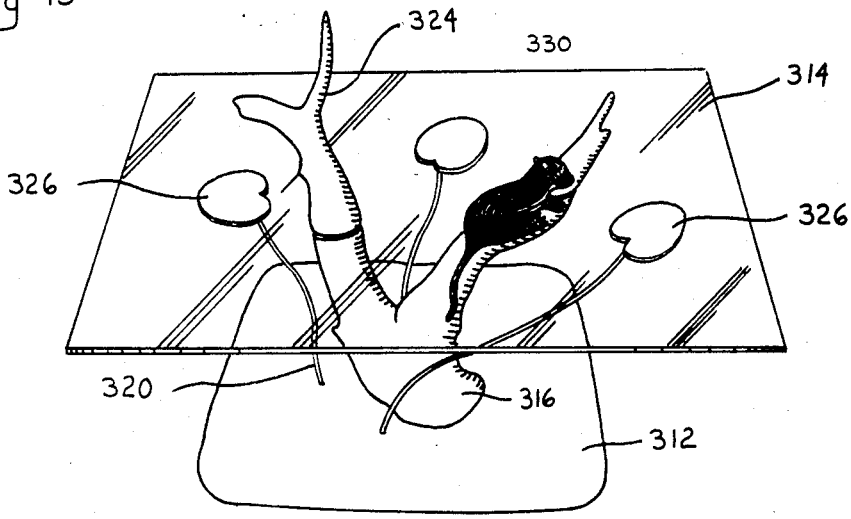
FIG. 13 is a perspective view of a seventh embodiment of the invention.
Figure 14:
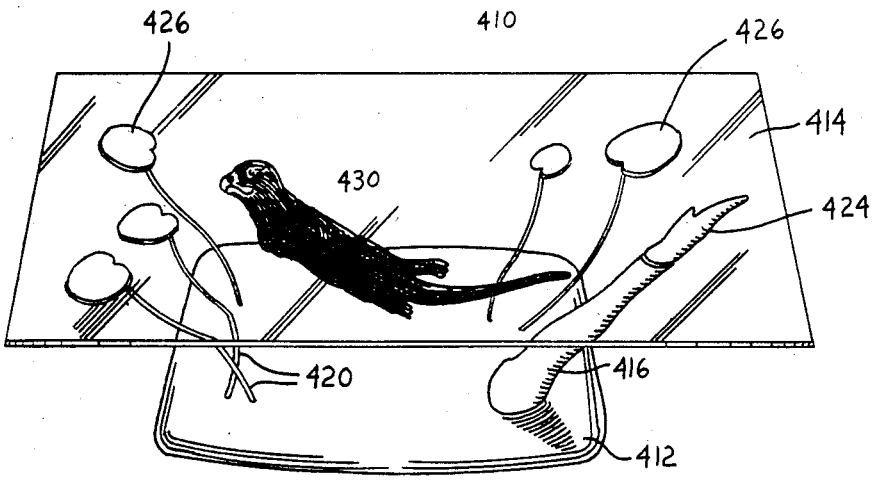
FIG. 14 is a perspective view of an eighth embodiment of the invention.

FIGS. 13 and 14 respectively depict variations 310 and 410 of this embodiment, each including an aquatic mammal FIG. 330 depicting a swimming muskrat (FIG. 13) and a mammal FIG. 430 depicting a swimming otter (FIG. 14) disposed as if swimming on the respective table top 314, 414.

Figure 15:
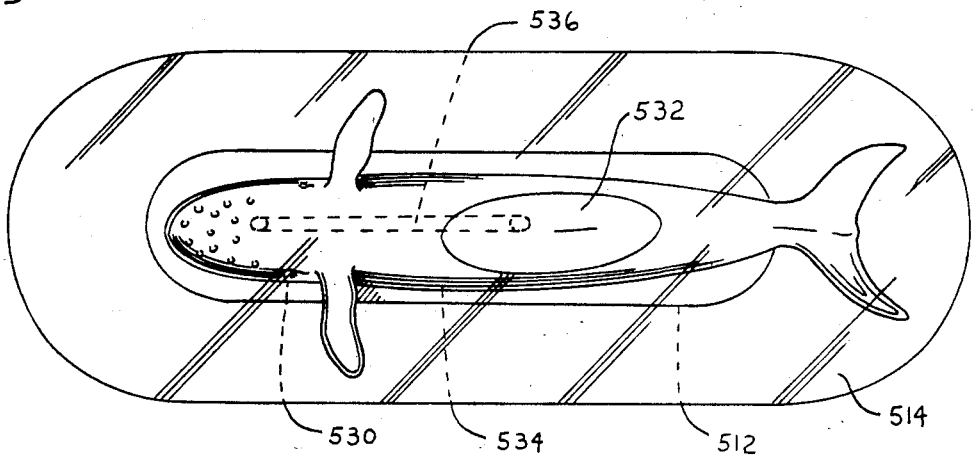
FIGS. 15 and 16 are plan and side elevation views of a nineth embodiment of the invention.
Figure 16:
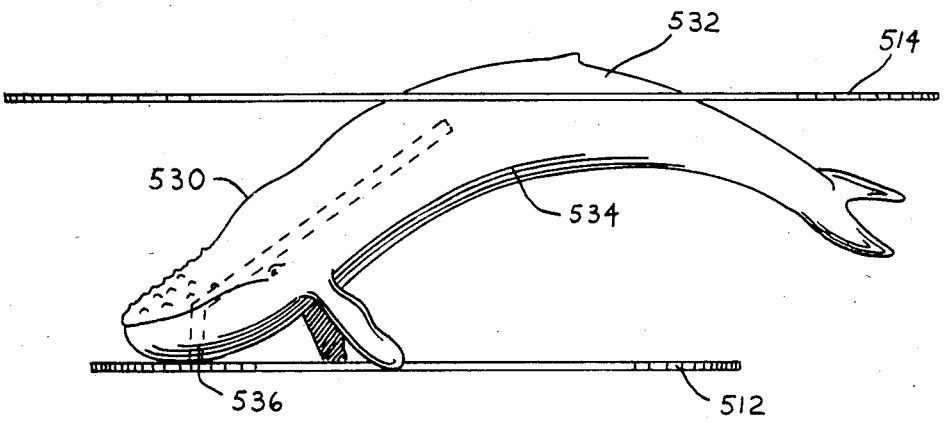

A table according to another embodiment of this invention is depicted in FIGS. 15 and 16. This embodiment is a "whale table", in which a whale FIG. 530 supports a glass table top 514. Here, a lower portion 534 of the whale FIG. 530, representing the submerged part of a swimming whale, is rigidly mounted onto a base 512, and this lower portion 534 has a flattened top section supporting the lower surface of the glass table top 514. An upper portion 532 of the whale FIG. 530 is aligned with the lower portion 534 thereof, and represents the part of the swimming whale that is breaking the surface of water. The upper portion 532 is secured by glue or by magnets, as desired.

An internal support 536 within the lower portion 534 of the whale FIG. 530 is fastened to the base 512. This support 536 gives strength to the lower figure portion 534 and supports most of the weight of both the FIG. 530 and the table top 514. In this embodiment, the fins and the flukes of the whale figure are out of contact with the ground surface on which rests the base 512. However, in suitable embodiments, one or more of these fins or flukes could provide additional support by contacting the ground surface.

In place of the whale, the FIG. 530 could be a representation of a seal, one or more dolphins, one or more penguins, a polar bear, or another ocean-going creature.

As mentioned previously, if all the upper parts of the creature FIGS. 30, 130, 130', 230, 330, 430, 530 and supports 24, 26 (i.e., driftwood or branches and lily pad stems) are attached by magnets, it becomes an easy matter to remove the table tops for replacement or for cleaning.

Also, the magnetically attached lower portion of the marine or aquatic animal FIG. 30, 130, 230, 330, 430 or 530 helps stabilize the upper part of the animal figure, and keeps it from moving if the table is bumped.

This table also serves an educational purpose. That is, the table of this invention provides a realistic display of any of various marine or aquatic animals swimming in their natural habitats. Because of the unique construction of this invention, the animal figures give a true appearance both of the animals' feet and legs, and of its head and back as well, when the animal is swimming or floating. Also, by interchanging the various marine or aquatic animals, the table of this invention can be used to help teach people to identify animals in their natural habitat, that is, when part or most of the animal is submerged in water.

In addition to the above, the table helps create an outdoor mood in the home or office environment. That is, a person can enjoy a realistic portion of the out-of-doors: The presence of the table of this invention in the home or office enables a person to feel as if he or she had a piece of the out-of-doors within his or her home or office.

In summary, with the table of this invention, the duck, loon, beaver, or other marine or aquatic animal figure is cut at its "water line", and the part representing the submerged portion of the animal is below the glass, with the upper part of the animal being above the glass. This gives a richer and more realistic representation of an aquatic animal than anything previously proferred. The similar treatment of branches, driftwood, lily pads, and other submerged objects enhance the realism in the simulated aquatic environment.

While several preferred embodiments of this invention have been described hereinabove, it should be recognized that many modifications and variations thereof would be apparent to those of ordinary skill in the art without departure from the scope and spirit of this invention, as defined in the appended claims.

I claim:

1. A decorative table in which objects on the table appear as natural objects emerging from the surface of a natural body of water, comprising a base; one or more support members generally rising from said base to a predetermined height; a flat transparent table top supported on said support members and providing the appearance of being the surface of said body of water; and one or more continuation members of said one or more support members attached to an upper surface of said table top and aligned with their respective support members to provide the illusion that said support members pierce the surface of said body of water, wherein said support members include rods rising from said base and support blocks on said rods on which the table top rests, and their respective continuation members include flat members fashioned to resemble leaves of aquatic plants, the rods resembling submerged stems thereof.

2. A decorative table according to claim 1 wherein certain ones of said support members include actual or simulated submerged tree branches, and their respective continuation support members include portions resembling upper tips of said submerged tree branches.

3. A decorative table according to claim 1, wherein said rods are swept from the vertical, at least slightly.

4. A decorative table in which one or more objects on the table appear to be supported in a natural body of water, comprising a base; a flat transparent table top having the appearance of being the surface of said body of water; support means supporting said table top a predetermined height over said base; an upper figure member fashioned to resemble an above-water portion of an aquatic or marine creature supported only on said table top; and a lower figure member fashioned to resemble an underwater portion of said aquatic or marine creature, the lower member being supported only by the table top on an under surface thereof and aligned with said upper member such that the upper and lower members together form an aquatic or marine animal figure to create the illusion of said aquatic or marine creature floating or swimming in water with the table top being substantially at the level of a natural waterline of said creature.

5. A decorative table according to claim 4, wherein the figure formed of said upper and lower figure members is about half-scale to substantially the same size as the marine or aquatic creature it resembles.

6. A decorative table according to claim 5, wherein said aquatic creature is selected from the group consisting of waterfowl and aquatic mammals.

7. A decorative table according to claim 6, wherein said aquatic creature is a waterfowl selected from the group consisting of loons and ducks.

8. A decorative table according to claim 6, wherein said aquatic creature is a mammal selected from the group consisting of beavers, muskrats, and otters.

9. A decorative table according to claim 4 wherein said upper figure member and said lower member each include magnetic means for coupling to one another across the thickness of said table top.

10. A decorative table according to claim 4, wherein said support means includes a plurality of support members rising from said base to said predetermined height and fashioned to render the appearance of submerged objects, the table further comprising continuation members of said support members attached to the upper surface of said table top and aligned with their associated support members to provide the appearance that said support members pierce the surface of said body of water.

11. A decorative table according to claim 10, wherein said support members include actual or simulated submerged tree branches and their respective continuation support members include portions resembling upper tips of said submerged tree branches extending above the surface of said body of water.

12. A decorative table according to claim 4, wherein said aquatic animal figure includes means permitting movement to various locations on said table top.

13. A decorative table according to claim 4, wherein there are more than one aquatic animal figure.

14. A decorative table in which one or more objects on the table appear to be supported in a natural body of water, comprising a base; a flat transparent table top creating the illusion of being the surface of said body of water; support means supporting said table top a predetermined height over said base; an upper figure member fashioned to resemble an above-water portion of an aquatic or marine creature supported on said table top; and a lower figure member fashioned to resemble an underwater portion of said aquatic or marine creature, the lower member being supported on a under surface of said table top aligned with said upper member such that the upper and lower members together form an aquatic or marine animal figure to create the illusion of said aquatic or marine creature swimming or floating with the table top being substantially at the level of a natural waterline of said creature; wherein said support means include a plurality of support members rising from said base to said predetermined weight and fashioned to render the appearance of submerged objects, the table further comprising continuation members of said support members attached to the upper surface of said table top and aligned with their associated support members to create the illusion that said support members pierce the surface of said body of water; and wherein said support members include rods rising from said base and support blocks on which said table top rests, and their associated continuation members include flat members fashioned to resemble leaves of pond lilies, the rods resembling submerged stems thereof.

15. A decorative table according to claim 14, wherein said rods are swept from the vertical, at least slightly.

16. A decorative table according to claim 10, including means for affixing at least certain ones of said continuation members in place on said table top.

17. A decorative table in which a figure representing a marine of aquatic creature appears to be swimming or floating at the surface of a body of water comprising:

a flat transparent table top fashioned to represent the surface of the body of water;

a base; and an aquatic or marine figure including an upper figure member fashioned to resemble a normally above-water portion of the aquatic or marine creature supported only on said table top, and a lower figure member fashioned to resemble a normally below-water portion of said creature, the lower member including support means within said lower figure member for bearing the weight of said table top and said figure and supporting said table top a predetermined height above said base, said lower member with said support means bearing against an under surface of said table top and on said base so that said table top is supported substantially only on said lower member and its included support means, said lower member being aligned with said member such that the upper and lower members together form said aquatic or marine figure to create the illusion of said aquatic or marine creature floating or swimming in water with the transparent table top being at the level of the waterline of said creature represented while swimming or floating in its natural habitat.

* * * * *

UNITED STATES PATENT AND TRADEMARK OFFICE

CERTIFICATE OF CORRECTION

PATENT NO. : 4,594,950

DATED : June 17, 1986

INVENTOR(S) : Keith Morris

It is certified that error appears in the above-identified patent and that said Letters Patent is hereby corrected as shown below:

Column 2, line 16 "pon" should read --pond--
Column 3, line 35 "FIG" should read --figure--
Column 3, line 39 "FIG" should read --figure--
Column 3, line 43 "FIG" should read --figure--
Column 3, line 57 "FIG" should read --figure--
Column 3, line 59 "FIG" should read --figure--
Column 3, line 65 "FIG" should read --figure--
Column 3, line 66 "FIG" should read --figure--
Column 4, line 42 "FIG" should read --figure--
Column 4, line 46 "FIG" should read --figure--
Column 4, line 55 "FIG" should read --figure--
Column 4, line 64 "FIGS" should read --figures--
Column 5, line 9 "FIG" should read --figure--
Column 5, line 11 "FIG" should read --figure--
Column 5, line 19 "FIG" should read --figure--
Column 5, line 20 "FIG" should read --figure--
Column 5, line 25 "FIG" should read --figure--
Column 5, line 27 "FIG" should read --figure--
Column 5, line 31 "FIG" should read --figure--
Column 5, line 37 "FIG" should read --figure--
Column 5, line 39 "FIG" should read --figure--
Column 5, line 46 "FIG" should read --figure--
Column 5, line 50 "FIGS" should read --figures--

UNITED STATES PATENT AND TRADEMARK OFFICE

CERTIFICATE OF CORRECTION

PATENT NO. : 4,594,950

DATED : June 17, 1986

INVENTOR(S) : Keith Morris

It is certified that error appears in the above-identified patent and that said Letters Patent is hereby corrected as shown below:

Column 5, line 56 "FIG" should read --figure--
Column 8, line 7, "weight" should read --height--.

Signed and Sealed this

Seventh Day of October, 1986

[SEAL]

*Attest:*

DONALD J. QUIGG

*Attesting Officer*

*Commissioner of Patents and Trademarks*